US005553397A

United States Patent [19]

Schwitzky et al.

[11] Patent Number: 5,553,397

[45] Date of Patent: Sep. 10, 1996

[54] DEVICE FOR DRYING PRINTED SHEETS OR WEB IN PRINTING PRESSES

[75] Inventors: Volkmar R. Schwitzky, Würzburg; Jürgen A. Stiel, Ostheim, both of Germany

[73] Assignee: Koenig & Bauer Aktiengesellschaft, Wurzburg, Germany

[21] Appl. No.: 398,896

[22] Filed: Mar. 3, 1995

[30] Foreign Application Priority Data

Mar. 3, 1993 [DE] Germany ..... 44 06 846.8

[51] Int. Cl.[6] ..... F26B 25/00

[52] U.S. Cl. ..... 34/640; 34/652; 34/656; 34/629

[58] Field of Search ..... 34/618, 640, 643, 34/652, 654, 655, 656, 629

[56] References Cited

U.S. PATENT DOCUMENTS

| | | | |
|---|---|---|---|
| 2,907,118 | 10/1959 | Maescher . | |
| 3,771,239 | 11/1973 | Minoda et al. | 34/640 |
| 3,957,187 | 5/1976 | Puigrodon | 34/643 |
| 3,979,038 | 9/1976 | Larlsson | 34/643 |
| 3,982,327 | 9/1976 | Kurie et al. | 34/643 |
| 4,135,312 | 1/1979 | Hope et al. | 34/655 |
| 4,218,001 | 8/1980 | Vits | 34/643 |
| 4,437,612 | 3/1984 | Russ et al. . | |

FOREIGN PATENT DOCUMENTS

| | | |
|---|---|---|
| 0103876 | 9/1983 | European Pat. Off. . |
| 883289 | 7/1953 | Germany . |

*Primary Examiner*—John T. Kwon
*Attorney, Agent, or Firm*—Jones, Tullar & Cooper, P.C.

[57] ABSTRACT

A device for drying printed webs or sheets in a printing press utilizes a blower box having a lower wall that is provided with an array of blower nozzles. Each nozzle is formed by a blower opening which is placed in a surface of the depression. The blower openings are oriented in a pattern that promotes complete and efficient paper web or sheet drying and tensioning.

4 Claims, 2 Drawing Sheets

DEVICE FOR DRYING PRINTED SHEETS OR WEB IN PRINTING PRESSES

FIELD OF THE INVENTION

The present invention is directed generally to a device for drying printed sheets or webs in a printing press. More particularly, the present invention is directed to a device for drying printed sheets or webs using a blower box having a plurality of bores. Most specifically, the present invention is directed to a device for drying printed sheets or webs using a blower box with a plurality of nozzles through which dry air is blown onto the freshly printed surface of the sheet or web. The blower box has a wall surface facing the freshly printed sheet or web. This wall surface is provided with an arrangement of depressions which face toward the sheet or web. Each depression has a particularly oriented blower opening with the sum of the blower openings being arranged in a pattern that accomplishes uniform drying and also tensions or tightens the paper web or sheet.

DESCRIPTION OF THE PRIOR ART

It is generally known in the art to dry freshly printed webs or sheets or paper by directing a stream of air onto the freshly printed surface of the web or sheet. One such prior art device is shown in German patent No. 883 289. In this device there is provided a conduit which is provided with holes in its cover or surface. Air under pressure is provided to the conduit and passes through the holes onto the surface of the web. The holes in this prior art drying conduit are arranged so that the compressed air is blown generally perpendicularly onto the paper web.

After the streams of air generated by this prior art device strike the surface of the freshly printed web or sheet, they flow off concentrically, as in a flat impact stream flow. Because no directed air flow is created by this prior art device, it is possible that dead spaces, or spaces which experience no drying air flow, will exist. It has been found that the existence of these dead spaces will have a detrimental effect on the drying of the freshly printed web or sheet. While some areas will be dried, others will not. This prior art device also cannot accomplish a tightening or tensioning effect on the paper web in the direction toward the lateral edges of the web or sheet due to the impact stream flow of the compressed air generated by the prior art device.

It will thus be apparent that a need exists for a drying device which overcomes the limitations of the prior art devices. The device for drying printed sheets or webs, in accordance with the present invention, provides such a device and is a significant improvement over the prior art.

SUMMARY OF THE INVENTION

It is an object of the present invention to provide a device for drying printed webs or sheets in a printing press.

Another object of the present invention is to provide a device for drying printed webs or sheets using a blower box having a plurality of bores.

A further object of the present invention is to provide a device for drying printed webs or sheets using a blower box with a plurality of compressed air directing nozzles.

Yet another object of the present invention is to provide a device for drying printed webs or sheets which facilitates the even and complete drying of the webs or sheets.

Still a further object of the present invention is to provide a device for drying printed sheets or webs in which the air flow through the nozzles of the blower box generates a tightening effect transversely to the feed direction and prevents so-called dead spaces, which are spaces in which no air movement takes place.

As will be discussed in greater detail in the description of the preferred embodiment which is set forth subsequently, the device for drying printed sheets or webs in accordance with the present invention utilizes a blower box having a wall surface facing the sheet or web to be dried. This blower box wall is provided with a plurality of outwardly facing depressions with each such depression having a surface in which there is formed an opening or bore through which dry air is directed onto the surface of the sheet or web to be dried. These depressions and their bores are arranged in the blower box wall at specific angles and in specific orientations with respect to the surface of the printed web or sheet and its direction of travel to accomplish thorough and uniform drying of the web or sheet as well as its lateral tightening.

The blower box wall surface is formed with its depressions, and with the blower openings which form the air nozzles, in a simple manner. The air streams that emanate from these nozzles are directed toward the traveling sheet or web, and impinge on the sheet or web, at an angle other than 90°. This orientation of the nozzle openings causes a tightening effect on the end and on the lateral edges of the sheet and a flow of air which allows the air to escape off the lateral edges of the sheet in a manner which prevents dead spaces that would hamper sheet or web drying. Overlap of the drying or blowing streams and thus even drying of the printing on the web or sheet is assured by the disposition of the nozzles in the device of the present invention.

It will thus be seen that the device for drying printed webs and sheets in accordance with the present invention overcomes the limitations of the prior art devices. It provides a substantial advance in the art.

BRIEF DESCRIPTION OF THE DRAWINGS

While the novel features of the device for drying printed sheets or webs in printing presses will be set forth with particularity in the appended claims, a full and complete understanding of the invention may be had by referring to the detailed description of the preferred embodiment which is presented subsequently, and as illustrated in the accompanying drawings, in which:

DETAILED DESCRIPTION OF THE PREFERRED EMBODIMENT

Figure 1:
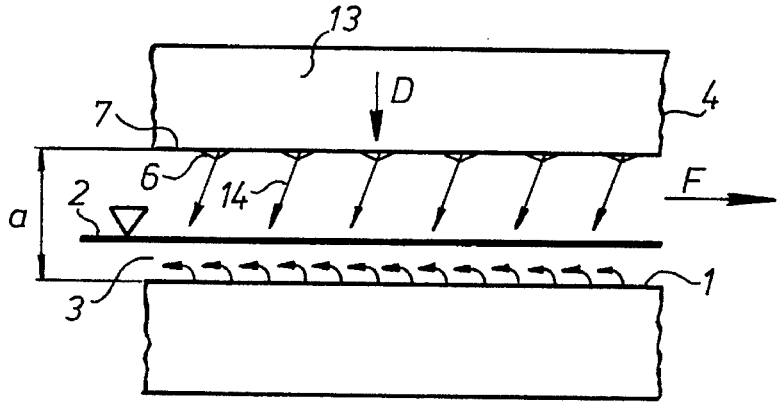
FIG. 1 is a schematic side elevation view of a device for drying printed sheets or webs in accordance with the present invention.

Referring initially primarily to FIG. 1, there may be seen a portion of a dryer or a device for drying a printed sheet or web in a printing press in accordance with the present invention. A guide surface 1 for the printed sheets or web 2 is located beneath the path of travel of the printed sheets or webs 2. The guide surface 1 provides an air cushion 3, in a generally well-known manner, along which the printed sheets or web 2 travels. The sheets or web 2 may be conveyed along the guide surface 1 on the air cushion 3 by any generally conventional means such as traveling gripper chains or conveyors or the like, which form no part of the present invention and which are not depicted specifically in the drawings.

A blower box, generally at 4, in accordance with the present invention, is disposed above the guide surface 1 and above the course of travel of the printed paper web or sheets 2. The spacing between a blower box lower wall 7 and the guide surface 1 is denoted by "a". This spacing "a" will be selected to provide sufficient space for travel of the chain conveyors or the like to transport the sheets or web 2. In the preferred embodiment, this space "a" may be in the area of 100 mm.

A plurality of blower nozzles, generally at 6, are formed or cut in the blower box lower wall surface 7 by use of a deep drawing tool. Each of these nozzles 6 faces generally in the direction of the guide surface 1. As may be seen most clearly in FIGS. 2 and 3, each individual blower nozzle 6 is formed by a depression 8 that is placed in the blower box lower wall 7. Each such depression 8 is directed generally toward the guide surface 1 and has an entry chamber 9 for compressed air and a surface 11 that is provided with a blower opening or aperture 12. These depressions 8 are directed out of the blower box lower wall 7 toward the guide surface 1, as indicated above, and thus form somewhat convex protrusions on the outer surface of the blower box lower wall 7. The outer surfaces 11 of these depressions 8, in which the blower openings 12 are formed, are angled or declined with respect to the planar outer surface of the lower wall 7 of the blower box 4 at an angle $\alpha$, as shown in FIG. 3. This angle $\alpha$, in accordance with the present invention, is generally in the range of 150°–170° with respect to wall 7 of the blower box 4.

Figure 2:
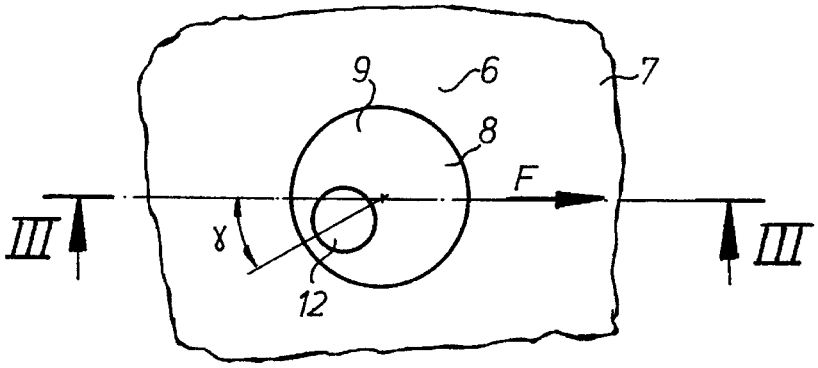
FIG. 2 is a top plan view of a portion of the blower wall of the present invention, taken in the direction indicated by arrow D in FIG. 1.
Figure 3:
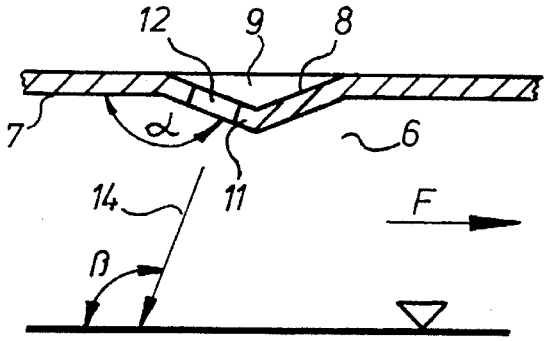
FIG. 3 is a cross-sectional view of the blower box wall taken along line III—III of FIG. 2.

As may be seen most clearly in FIGS. 2 and 3, the blower openings 12 are cut or otherwise formed in the surface 11 of the depressions 8 formed in the blower box bottom wall 7. Compressed air 13 is supplied to the blower box 7 from any suitable source, and flows through each of the blower openings 12. Each such blower opening 12 thus forms its own blower stream 14 with one such stream 14 being depicted schematically in FIG. 3. Each such blower stream 14 is generally perpendicular to the plane of the blower opening 12 and the surface 11 of the associated blower nozzle 6 and thus strikes or contacts the sheet or web 2 and an angle $\beta$ which is in the range of 100° to 120°. This angle means that the direction of travel of each blower stream is opposed to the direction of travel, indicated by arrow F in FIGS. 1–4, of the sheet or web. If angle $\beta$ were 90° then the blower stream would be perpendicular to the direction of travel F. However, since the angle $\beta$ is 100° to 120°, the direction of travel of the blower streams 14 from the blower nozzles 6 is counter to or in a direction opposite to the direction F of paper web or sheet travel.

The blower opening 12 in each depression 8 is, in accordance with the present invention, generally circular and may have a diameter of 10 mm. The depression can have the shape of a pyramid, truncated pyramid, tetrahedron, spherical dome, or truncated circular cone. As depicted in the present drawings, the surface 11 is part of a circular cone.

Figure 4:
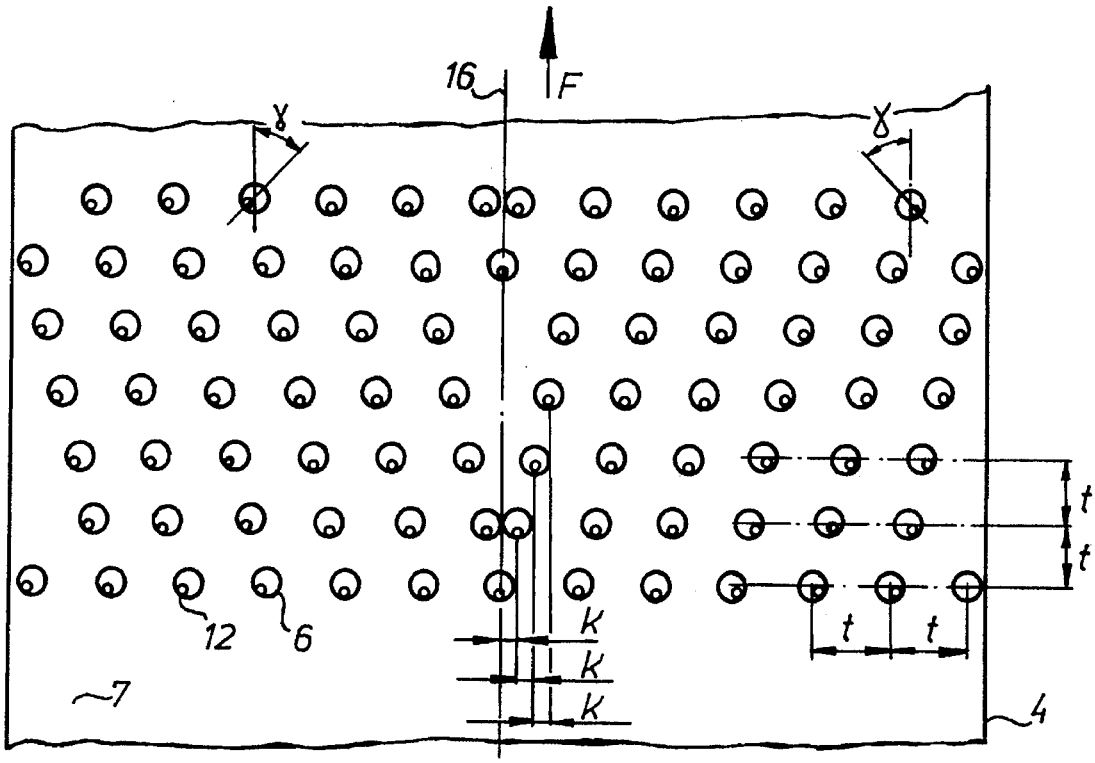
FIG. 4 is a plan view of the blower box wall of FIG. 1 and showing the orientation of the depressions and nozzles in accordance with the present invention.

As may be seen by referring to FIGS. 2 and 4, each surface 11 in its associated depression 8 may be turned in the plane of the wall 7 of the blower box by an angle $\gamma$. This will angulate or direct the blower stream 14 formed by each blower nozzle 6 with respect to an axis of symmetry 16 that is located along the center of the blower box 4 in the direction F of sheet or web conveyance. An arrangement of the blower nozzles 6 pointing away from this axis of symmetry 16 and opposite to the conveying direction F, as is depicted by the several outermost columns of blower nozzles 6, as seen in FIG. 4, will effect a tightening effort on the sheets or web 2 and a removal of the air toward the trailing edge of the sheet or web 2. The axis of symmetry 16 extends parallel to the conveying direction F and symmetrically divides the width of the blower box bottom wall 7 in half in the direction perpendicular to the conveying direction F, as shown in FIG. 4. The various blower openings 12 are varied across the width of the blower box bottom wall so that the angle $\gamma$ of these openings ranges from 45° below to 45° above, again as seen in FIG. 4, with respect to the axis of symmetry 16. In an area located to the right and left of the axis of symmetry 16, and having a width of generally 200 mm, the angle $\gamma$ may be 0°. The angle $\gamma$ will increase to 45° below or 45° above in areas further away from the line of symmetry 16. Still further areas with different angles $\gamma$ of orientations of blower opening 12 can also be provided.

Turning again primarily to FIG. 4, the blower nozzles 6 are arranged in the blower box lower wall 7 in columns extending generally in the conveying direction F, and in rows which are perpendicular to the conveying direction F. The overall pattern formed by the array of blower nozzles 6 is a generally arrowhead or V-shape with the apex of the arrowheads or V's pointing against the conveying direction F. The spacing t between each row of nozzles 6 and the spacing between each blower nozzle in each row is in the range of 50 to 100 mm. Starting at the axis of symmetry 16, each column of blower nozzles 6 is offset from each succeeding column by a constant K. This constant K is a function of the spacing t and in the preferred embodiment the offset constant K is one fifth of the spacing distance t so that $K=t/5$. By placing the columns of blower nozzles C at this offset K, overlapping of the blower streams 14, as viewed in the conveying direction F, is attained as a function of the diameter of the blower openings 12, without the blower streams 14 affecting each other. As discussed above, the spacing and location of the blower nozzles 6 in the blower box 4 forms a generally arrow-shaped array with the point of each arrow lying on the axis of symmetry 16 and with the arrowhead opening in the conveying direction F.

While a preferred embodiment of a device for drying printed sheets or webs in printing presses in accordance with the present invention has been set forth fully and completely hereinabove, it will be apparent to one of skill in the art that a number of changes in, for example, the means for supplying compressed air to the blower box, the means for conveying the paper webs or sheets, the type of web or sheet being dried and the like may be made without departing from the true spirit and scope of the present invention which is accordingly to be limited only by the following claims.

What is claimed is:

1. A device for drying a printed medium in a printing press comprising:

a blower box having a blower box wall spaced above a printed medium guide surface;

a plurality of depressions formed in said blower box wall and extending outwardly from said wall toward said printed medium guide surface;

a wall surface formed in each of said depressions, each said wall surface being outwardly inclined with respect to said blower box wall at an angle of 150° to 170° with respect to said blower box wall; and a blower opening formed in each of said depression wall surfaces, each of said blower openings directing dry air supplied to said blower box toward said printed medium guide surface as a blower stream.

2. The device in accordance with claim 1 wherein a printed medium to be dried is conveyed through said blower box in a conveying direction and further wherein said blower streams overlap in a direction transverse to said conveying direction.

3. The device in accordance with claim 2 wherein said blower openings in said blower box wall are oriented at a direction of from 45° below to 45° above said conveying direction.

4. The device in accordance with claim 2 wherein said blower openings in said blower box wall are arranged in a V- shape, said V-shape opening in said conveying direction.

* * * * *